US007246894B2

(12) United States Patent
Hattori et al.

(10) Patent No.: US 7,246,894 B2
(45) Date of Patent: Jul. 24, 2007

(54) INK CARTRIDGES

(75) Inventors: Shingo Hattori, Tsushima (JP); Tomohiro Kanbe, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

(21) Appl. No.: 11/536,677

(22) Filed: Sep. 29, 2006

(65) Prior Publication Data

US 2007/0070153 A1 Mar. 29, 2007

Related U.S. Application Data

(60) Provisional application No. 60/826,254, filed on Sep. 20, 2006.

(30) Foreign Application Priority Data

Sep. 29, 2005 (JP) ..... 2005-284646
Nov. 28, 2005 (JP) ..... 2005-342689
Mar. 23, 2006 (JP) ..... 2006-081806

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/84–86; 425/542, 543
See application file for complete search history.

(56) References Cited

U.S. PATENT DOCUMENTS 4,199,343 A * 4/1980 Eolin et al. ..... 65/157
4,610,202 A * 9/1986 Ebinuma et al. ..... 101/364
6,886,928 B2 5/2005 Sasaki et al.
2005/0068389 A1* 3/2005 Katayama et al. ..... 347/86
2006/0164482 A1 7/2006 Katayama et al.
2007/0070136 A1* 3/2007 Hattori et al. ..... 347/86

FOREIGN PATENT DOCUMENTS

JP 7314716 A 12/1995

* cited by examiner

*Primary Examiner*—Stephen Meier
*Assistant Examiner*—Geoffrey S. Mruk
(74) *Attorney, Agent, or Firm*—Baker Botts, L.L.P.

(57) ABSTRACT

An ink cartridge includes an ink chamber, and a translucent portion configured to be in fluid communication with the ink chamber. The translucent portion has an inner space formed therein, and the translucent portion includes a first wall, a second wall opposite the first wall, and a third wall connected to each of the first wall and the second wall. The ink cartridge also includes a signal blocking member disposed within the inner space of the translucent portion between the first wall and the second wall, and a translucent portion rib disposed within the inner space of the translucent portion between the first wall and the second wall. Moreover, the translucent portion rib extends a from the third wall, and a first distance between the translucent portion rib and the first wall is less than a second distance between the signal blocking member and the first wall.

19 Claims, 11 Drawing Sheets

INK CARTRIDGES

CROSS-REFERENCE TO RELATED APPLICATIONS

The present application claims priority from Japanese Patent Application No. JP-2005-284646, which was filed on Sep. 29, 2005, Japanese Patent Application No. JP-2005-342689, which was filed on Nov. 28, 2005, Japanese Patent Application No. JP-2006-081806, which was filed on Mar. 23, 2006, and U.S. Provisional Patent Application No. 60/826,254, which was filed on Sep. 20, 2006, the disclosures of which are incorporated by reference in their entirety.

BACKGROUND OF THE INVENTION

1. Field of the Invention

The present invention relates generally to ink cartridges. In particular, the present invention is directed towards ink cartridges which may be used in combination with ink jet printers.

2. Description of Related Art

Ink cartridges which are configured to be used in combination with ink jet printers are known in the art.

SUMMARY OF THE INVENTION

According to an embodiment of the present invention, an ink cartridge comprises an ink chamber, and a translucent portion configured to be in fluid communication with the ink chamber. The translucent portion has an inner space formed therein, and the translucent portion comprises a first wall, a second wall opposite the first wall, and a third wall connected to each of the first wall and the second wall. The ink cartridge also comprises a signal blocking member disposed within the inner space of the translucent portion between the first wall and the second wall, and a translucent portion rib disposed within the inner space of the translucent portion between the first wall and the second wall. Moreover, the translucent portion rib extends a from the third wall, and a first distance between the translucent portion rib and the first wall is less than a second distance between the signal blocking member and the first wall.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

FIG. 3(*b*) is a cross-sectional view of the signal blocking portion, the translucent portion rib, and the translucent portion of FIG. 3(*a*) along the XVIIIb-XVIIIb line; FIG. 3(*c*) is a cross-sectional view of the signal blocking portion, the translucent portion rib, and the translucent portion of FIG. 3(*a*) along the XVIIIc-XVIIIc line, according to an embodiment of the present invention; and FIGS. 3(*d*)-3(*g*) are cross-sectional views of the signal blocking portion, the translucent portion rib, and the translucent portion according to alternative embodiments of the present invention.

FIG. 4(*b*) is a view of the movable member of FIG. 4(*a*) along the arrow XIXb perspective, according to an embodiment of the present invention.

FIG. 5(*b*) is a side view of the front of the ink reservoir element of FIG. 5(*a*); and FIG. 5(*c*) is a cross-sectional view of the ink reservoir element of FIG. 5(*a*) along the XXc-XXc line, according to an embodiment of the present invention.

FIG. 8(*b*) is a side view of the ink reservoir element of FIG. 8(*a*) showing the position of the movable member when there is no ink within the ink reservoir element, according to an embodiment of the present invention.

FIG. 9(*b*) is a perspective view of an ink cartridge according to yet another embodiment of the present invention

DETAILED DESCRIPTION OF EMBODIMENTS

Embodiments of the present invention and their features and technical advantages may be understood by referring to FIGS. 1-10, like numerals being used for like corresponding portions in the various drawings.

Figure 1:
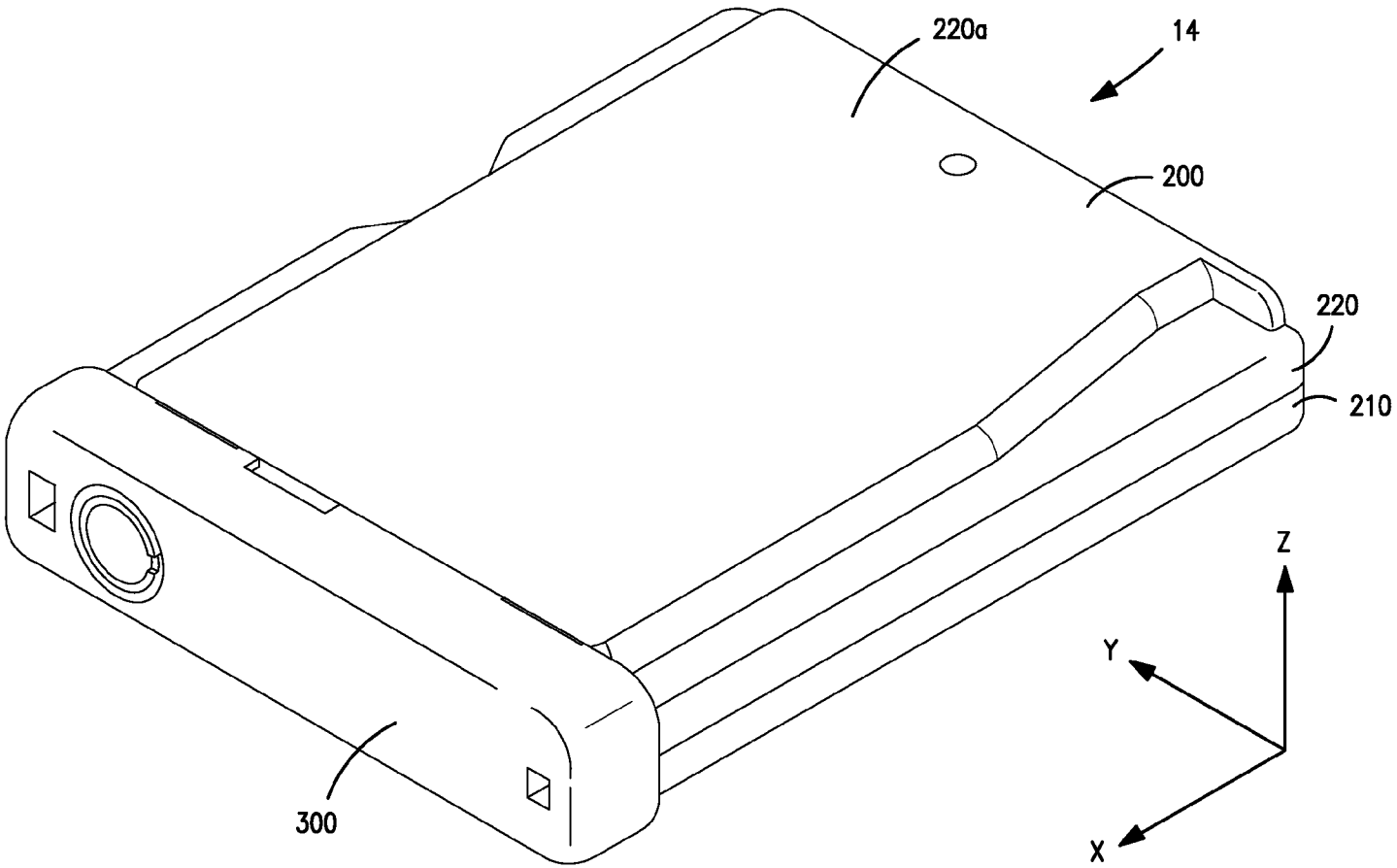
FIG. 1 is a perspective view of an ink cartridge, according to an embodiment of the present invention.
Figure 2:
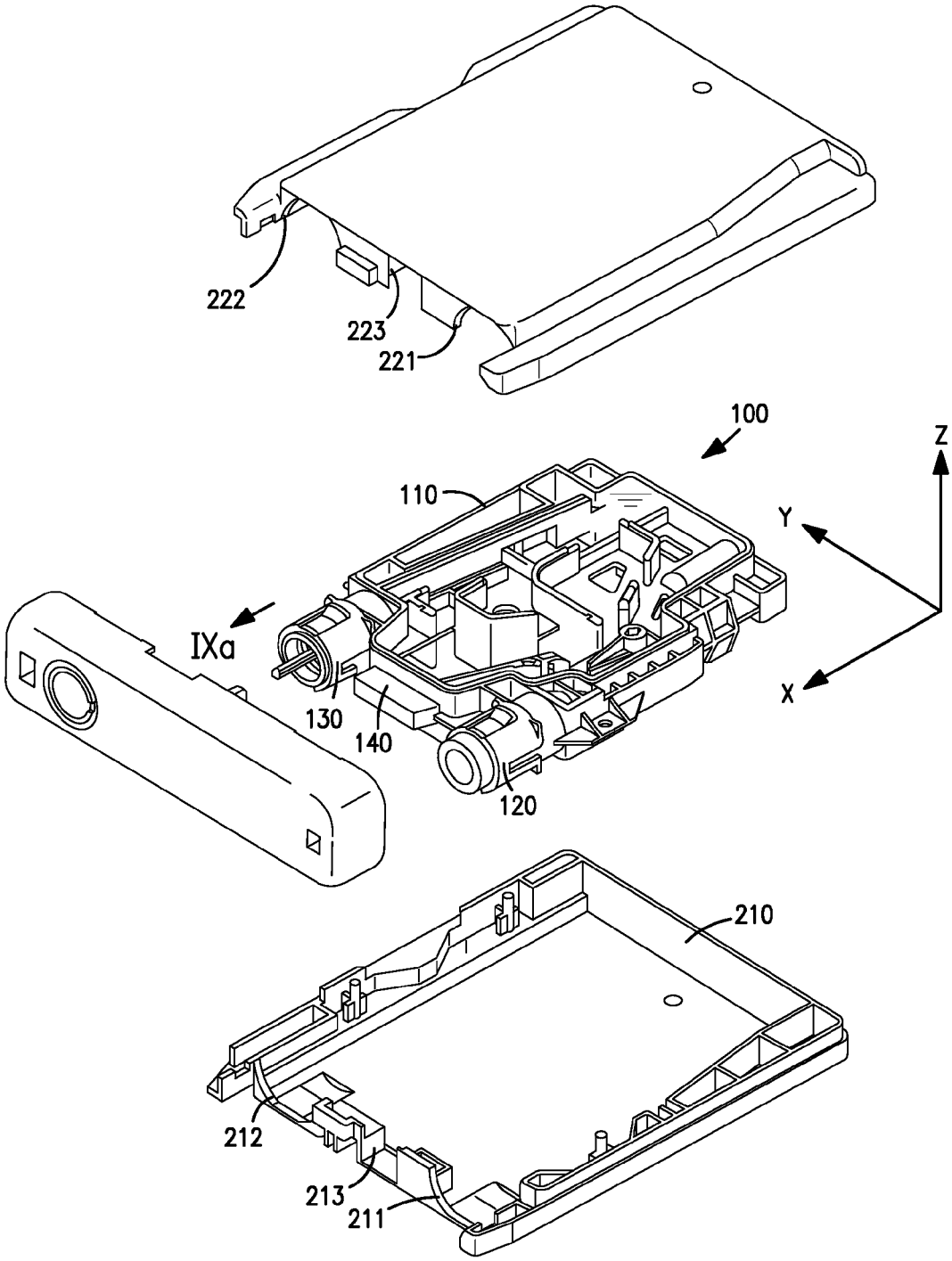
FIG. 2 is an expanded, perspective view showing an interior of the ink cartridge of FIG. 1, according to an embodiment of the present invention.
Figure 3A:
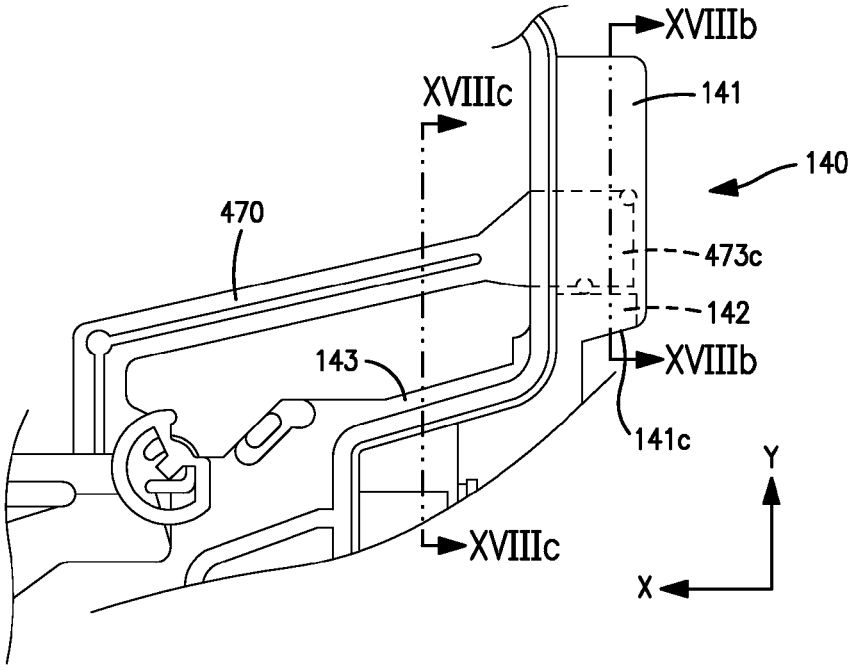
FIG. 3(*a*) is a side view of a signal blocking portion of a movable member, which is disposed within an inner space of a translucent portion, and a translucent portion rib.
Figure 3B:
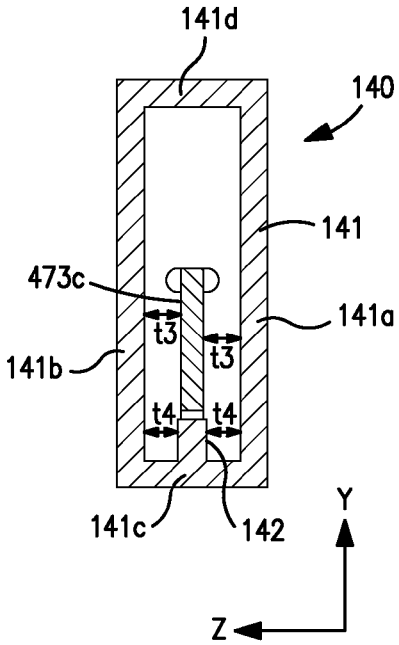
Figure 3C:
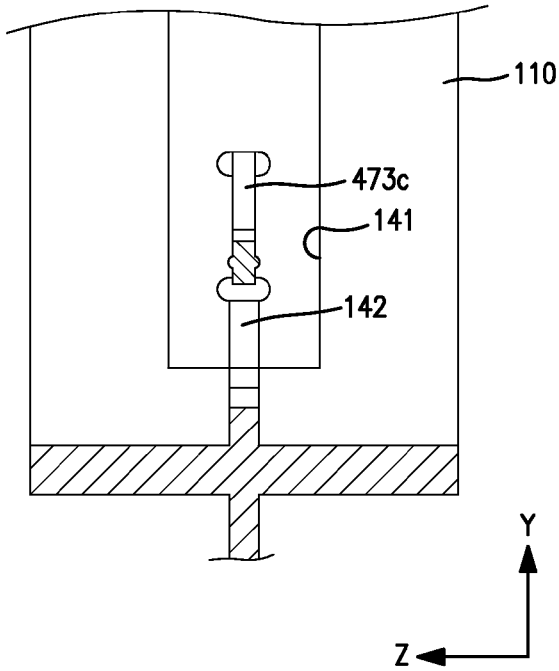
Figure 3D:
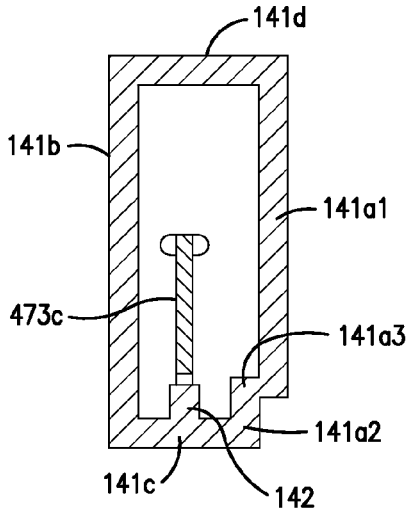
Figure 3F:
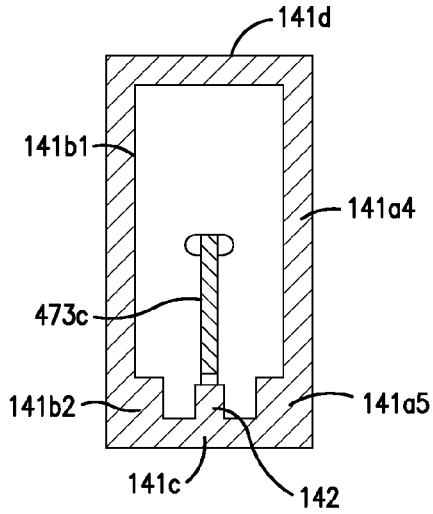
Figure 3E:
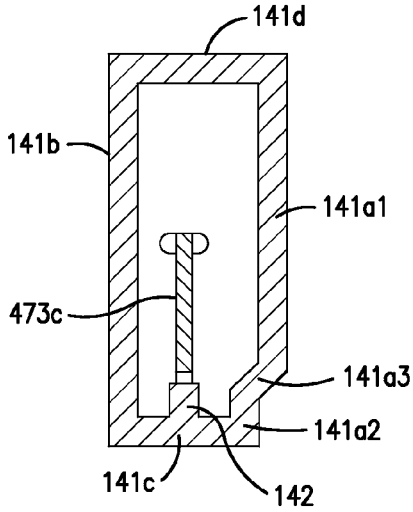
Figure 3G:
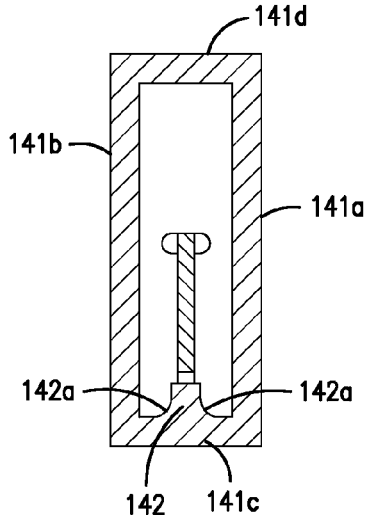
Figure 7:
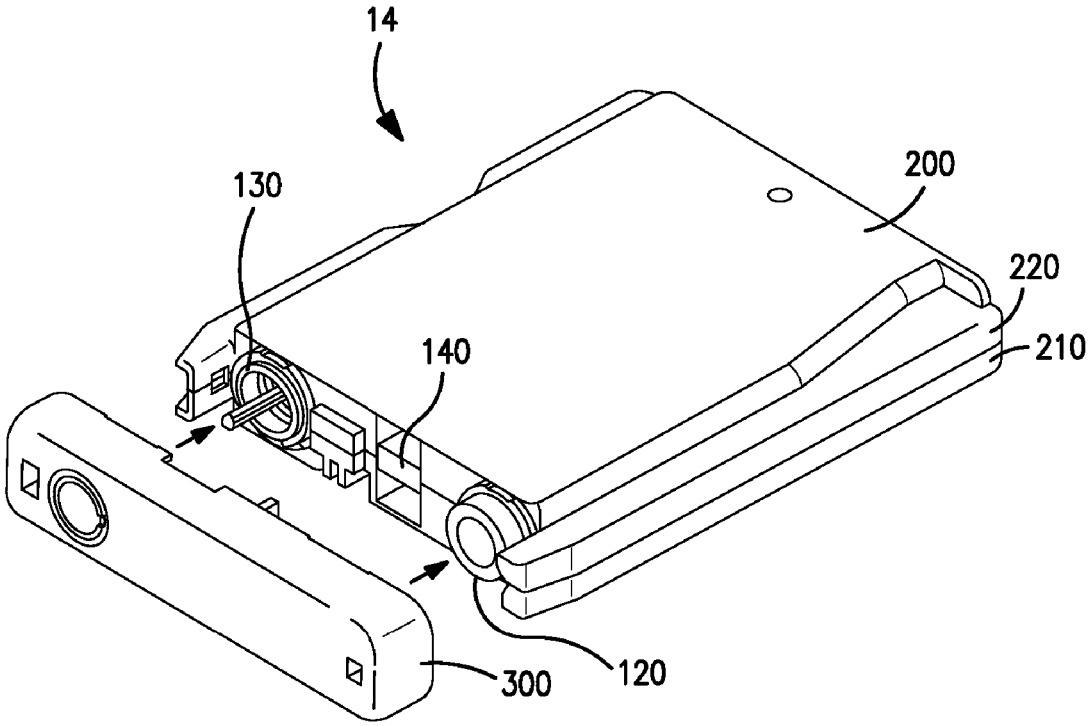
FIG. 7 is a perspective view of an ink cartridge showing a process for attaching a protective cap to the ink cartridge, according to an embodiment of the present invention.
Figure 8B:
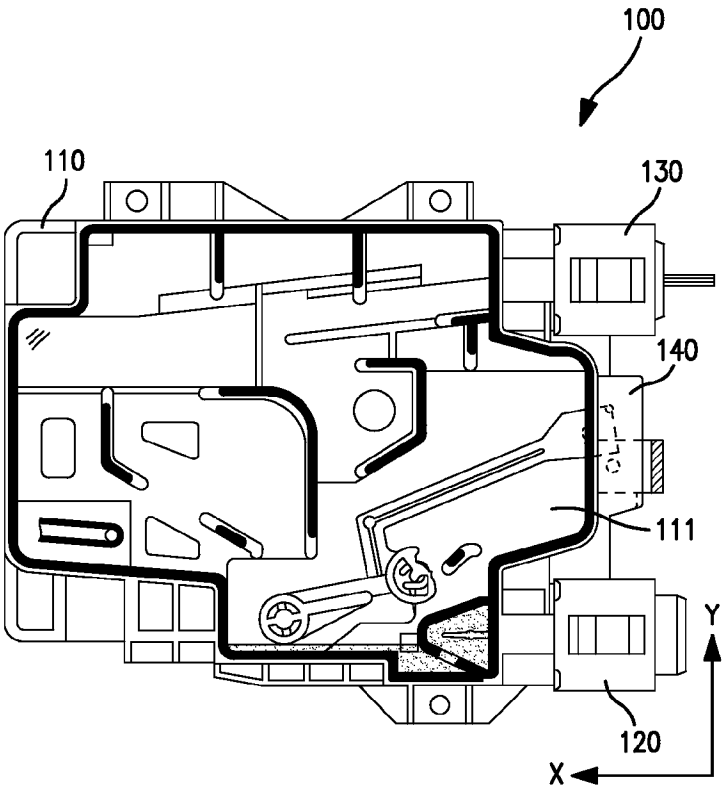
FIG. 8(*a*) is a side view of an ink reservoir element showing the position of a movable member when there is ink within the ink reservoir element.
Figure 8A:
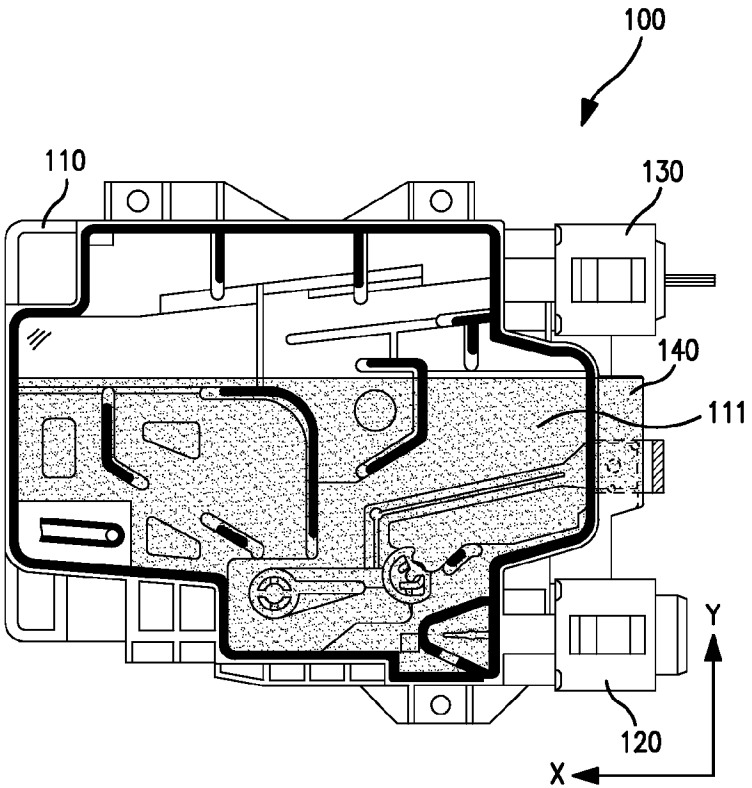

Referring to FIGS. 1, 2, and 7, an ink cartridge 14 may comprise an ink reservoir element 100 which is configured to store ink, a case 200 which may substantially cover the entire body of ink reservoir element 100, and a protector 300 which may be attached to case 200 and protects ink reservoir element 100 when ink cartridge 14 is in transit. Case 200 may have a substantially rectangular, parallelepiped shape. In an embodiment of the present invention, ink reservoir element 100, case 200, protector 300, and all of the members contained in ink cartridge 14 may comprise non-metal materials, e.g., may comprise resin materials, such that they may be burned at the time of disposal. For example, nylon, polyester, or polypropylene may be used as resin materials.

Ink reservoir element 100 may comprise a frame portion 110 which forms an ink chamber 111 which is configured to store ink, an ink supply portion 120 which is configured to supply ink stored in ink chamber 111 to a multifunction device (not shown), such as a printer, and an ambient air intake portion 130 which is configured to introduce ambient air into frame portion 110. Ink reservoir element 100 also may comprise a translucent portion 140 which may allow for the detection of the amount of ink stored in ink chamber 111.

Case 200 may comprise a first case member 210 and a second case member 220 which are configured to sandwich ink reservoir element 100. First case member 210 may be a member which covers the bottom side surface of ink reservoir element 100, and second case element 220 may be a member which covers the top side surface of ink reservoir element 100. First and second case members 210 and 220 may comprise at least one resin material, and may be manufactured using injection molding.

A pair of case cutout portions 211 and 212 may be provided through first case member 210 for exposing ink supply portion 120 and ambient air intake portion 130, respectively, to the outside of case 200. Case cutout portions 211 and 212 may be substantially semicircular. A case cutout portion 213 also may be provided through first case member 210 between case cutout portion 211 and case cutout portion 212, and case cutout portion 213 may be for receiving a sensor (not shown) of the multifunction device at a position where the sensor sandwiches translucent portion 140. For example, case cutout portion 213 may have a substantially square or rectangular shape. Similarly, second case member 220 may comprise case cutout portions 221, 222, 223, which may correspond to case cutout portions 211, 212, and 213, respectively. When first case member 210 is connected to second case member 220 to form case 200, case cutout portions 211 and 221 may form a first opening, case cutout portions 212 and 222 may form a second opening, and case cutout portions 213 and 223 may form a third opening. Moreover, when ink reservoir element 100 is positioned within case 200, ink supply portion 120 may protrude from the first opening, ambient air intake portion 130 may protrude from the second opening, and a portion of translucent portion 140 may be aligned substantially flush with the third opening.

Referring to FIG. 3(*a*), translucent portion 140 may protrude outward from frame portion 110. Translucent portion 140 may comprise an enclosure portion 141 which encloses the end of a movable member 470, e.g., a signal blocking portion 473*c* of movable member 470, by sandwiching the end of movable member 470 within a plurality of walls, e.g., a first wall 141*a*, a second wall 141*b*, a third wall 141*c*, and a fourth wall 141*d*, of enclosure 141, and forms a passage through which movable member 470 may be displaced. Translucent portion 140 also may comprise a translucent portion rib 142 which may support movable member 470 from below. Translucent portion rib 142 may be translucent or may not be translucent. Translucent portion rib 142 may be positioned in the center of the width direction of the passage within translucent portion 140, and it may be arranged, such that the end of movable member 470 also is positioned in the center of the passage within translucent portion 140. For example, translucent portion rib 142 may be positioned between first wall 141*a* and second wall 141*b*, and may extend from third wall 141*c* towards fourth wall 141*d*. Moreover, an area of first wall 141*a* and second wall 141*b* each may be greater than an area of third wall 141*c* and fourth wall 141*d*.

Movable member 470 may rotate based on the amount of ink within ink chamber 111, and it may be a member which may be used in combination with the sensor to detect whether the amount of ink within ink chamber 111 is sufficient by detecting the position of signal blocking portion 473*c*. The sensor may comprise a light emitting portion and a light receiving portion, and translucent portion 140 may be positioned therebetween. Therefore, when signal blocking portion 473*c* is positioned in the light path between the light emitting portion and the light receiving portion, it blocks the light transmitted by the light emitting portion. Consequently, by rotating based on the amount of ink within ink chamber 111, movable member 470 may change the amount of light received by the light receiving portion and may be used to detect the presence or absence of ink. Third wall 141*c* may be slanted with respect to first wall 141*a* and second wall 141*b*, e.g., the right side of third wall 141*c* may be higher than the left side of third wall 141*c* as shown in FIG. 3(*a*), such that ink readily may flow out of enclosure portion 141 as the ink is depleted.

Referring to FIG. 3(*b*), the thickness of translucent portion rib 142 may be selected, such that a gap t4 between the inside walls of enclosure portion 141 and the outside wall of translucent portion rib 142 may be less than a gap t3 between the inside walls of enclosure 141 and the outside of movable member 470. When liquid surface I of the ink falls below translucent portion 140, the ink within translucent portion 140 may be depleted, however, because gap t3 between movable member 470 and enclosure 141 may be relatively small, ink may remain within translucent portion 140 due to the surface tension of the ink, and movable member 470 may not rotate normally due to the surface tension of the ink. Nevertheless, by forming translucent portion rib 142, such that gap t3 is greater than gap t4, capillary force generated between translucent portion rib 142 and enclosure portion 141 may be greater than the capillary force generated between movable member 470 and enclosure portion 141. Consequently, the ink which remains within enclosure portion 141 may be drawn between translucent portion rib 142 and enclosure portion 141, such that it may be possible to substantially prevent ink from remaining between movable member 470 and enclosure portion 141. As such, the amount of ink may be accurately detected.

Referring to FIG. 3(*d*), in an embodiment of the present invention, first wall 141*a* may be divided into a plurality of portions, e.g., a first wall portion 141*a*1, a second wall portion 141*a*2, and a third wall portion 141*a*3. For example, first wall portion 141*a*1 may be connected to second wall portion 141*a*2 via third wall portion 141*a*3 . First wall portion 141*a*1 and second wall portion 141*a*2 may be unaligned with each other and may be parallel with each other, and third wall portion 141*a*3 may be perpendicular to first wall portion 141*a*1 and second wall portion 141*a*2. Alternatively, referring to FIG. 3(*e*), third wall portion 141*a*3 may be slanted with respect to first wall portion 141*a*1 and second wall portion 141*a*2. Referring to FIG. 3(*f*), in an embodiment of the present invention, first wall 141*a* may be divided into a first wall portion 141*a*4 and a second wall portion 141*a* 5, and second wall 141*b* may be divided into a first wall portion 141*b*1 and a second wall portion 141*b*2. The inside wall of first wall portion 141*a*4 may be unaligned with the inside wall of second wall portion 141*a*5, and the outside wall of first wall portion 141*a*4 may be aligned with the outside wall of second wall portion 141*a*5. The inside wall of first wall portion 141*b*1 may be unaligned with the inside wall of second wall portion 141*b*2, and the outside wall of first wall portion 141*b*1 may be aligned with the outside wall of second wall portion 141*b*2. Moreover, referring to FIGS. 3(*b*) and 3(*g*), an intersection between translucent portion rib 142 and third wall 141*c* may comprise at least one right angle and/or at least one rounded portion 142*a*. The capillary force of the right-angled intersection between translucent portion rib 142 and third wall 141*c* may be greater than that of the intersection comprising at least one rounded portion 142*a*. In each case shown in FIGS. 3(*b*), (*d*), (*e*), and (*f*), a gap between the inside walls of enclosure portion 141 and the outside wall of translucent portion rib 142 may be less than a gap between the inside walls of enclosure 141 and the outside of movable member 470.

Referring to FIG. 3(*a*), ink chamber rib 143 which is connected to translucent portion rib 142 may be provided on the inside wall of frame portion 110, and at least a portion of ink chamber rib 143 may be slanted with respect to translucent portion rib 142. Ink chamber rib 143 may comprise a first portion and a second portion connected to the first portion. The first portion may be disposed adjacent to and perpendicular to translucent portion rib 142, and the second portion is slanted with respect to translucent portion rib 142 and the first portion. Ink may run down along the intersection between translucent portion rib 142 and third wall 141*c* and along the intersection between ink chamber rib 143 and the inside wall of frame portion 110 as ink is depleted.

Figure 4B:
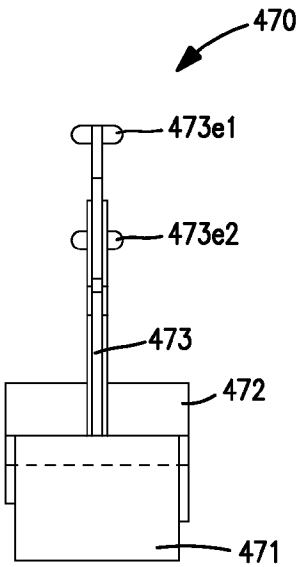
FIG. 4(*a*) is a front view of a movable member having a float member and a signal blocking member.
Figure 4A:
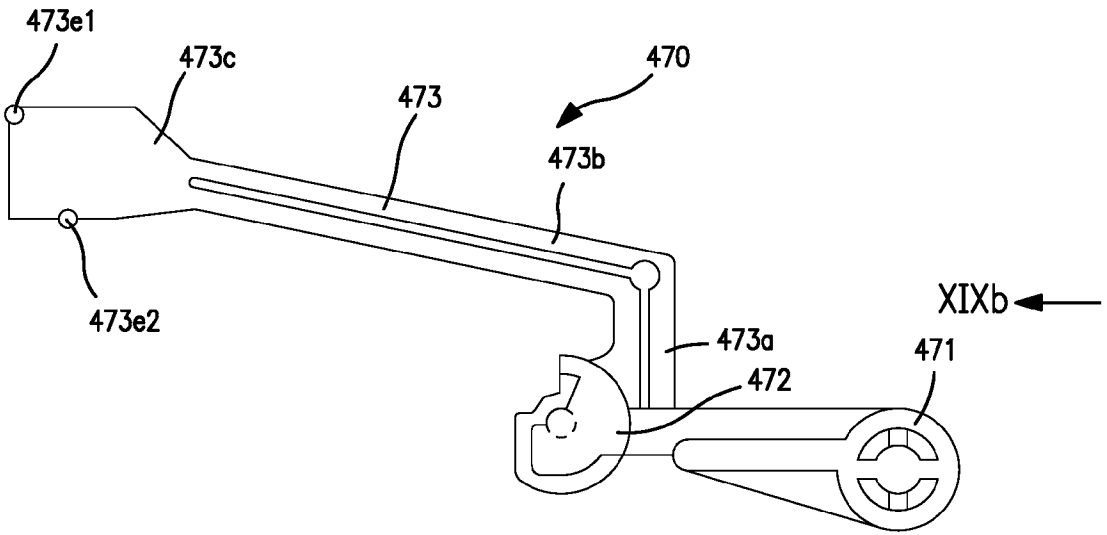

Referring to FIGS. 4(*a*) and 4(*b*), movable member 470 may be a member for detecting the amount of ink within ink chamber 111. Movable member 470 may be manufactured by injection molding using a resin material, e.g., polypropylene, and it has light-blocking properties, e.g., it may be opaque. Movable member 470 may be a rotating member which rotates based on the amount of ink within ink chamber 111, and a portion of movable member 470 may be detected by the sensor which detects the amount of ink stored within ink chamber 111. Movable member 470 may comprise a float portion 471 which may comprise a material with a specific gravity which is less than the specific gravity of ink, a pivot portion 472 which may be attached to frame portion 110, such that it may pivot, and an arm portion 473, which extends from pivot portion 472 in a direction which may be substantially orthogonal to float portion 471. Pivot portion 472 may be a linking portion which connects float portion 471 and arm portion 473. In operation, when movable member 470 rotates upward, movable member 470 contacts a ceiling surface of translucent portion 140, and the rotation of movable member 470 may be restricted. Therefore, it may be possible to prevent movable member 470 from moving out of translucent portion 140.

Arm portion 473 may comprise a vertical arm portion 473*a* which extends in a direction which is substantially perpendicular to float portion 471, a sloping arm portion 473*b* which slopes upward from vertical arm portion 473*a*, and a signal blocking portion 473*c*, which may be used as a light-blocking portion which blocks the light transmitted by the light emitting portion of the sensor.

Referring to FIG. 4(*b*), arm portion 473 may be substantially thinner than float portion 471 and pivot portion 472. Specifically, if arm portion 473 has a thick profile, the scale of translucent portion 140 may be increased, and consequently, the size of ink cartridge 14 and the resistance when movable member 470 rotates also may increase, which makes it difficult to accurately detect the amount of ink. Further, when the thickness of translucent portion 140 increases, the gap between the light emitting portion and the light receiving portion of the sensor widens accordingly, and the detection sensitivity deteriorates, which increases the costs associated with the sensor. Therefore, arm portion 473 may have a relatively thin profile. A plurality of ribs 473*d* may be provided on vertical arm portion 473*a* and sloping arm portion 473*b*, which may increase the strength of arm portion 473.

A pair of substantially semispherical arm protruding portions 473*e*1 and 473*e*2 may be provided on signal blocking portion 473*c* on the top and the bottom of the portion housed within translucent portion 140, respectively. Arm protruding portions 473*e*1 and 473*e*2 may reduce the likelihood of signal blocking portion 473*c* adhering to the inside wall of translucent portion 140 due to the surface tension of the ink. For example, because arm protruding portions 473*e*1 and 473*e*2 may have a substantially semispherical shape, the only portion which contacts the inside wall of translucent portion 140 may be the end of arm protruding portions 473*e*1 and 473*e*2, such that the effects of the surface tension of the ink may be reduced.

Float portion 471 may comprise a resin material with a specific gravity which is less than the specific gravity of ink, such that when liquid surface I of the ink is lowered, float portion 471 moves in the direction of the bottom portion of frame portion 110, i.e., float portion 471 and liquid surface I of the ink move in the same direction as ink is dispensed. When float portion 471 moves in the direction of the bottom portion, and arm portion 473 moves in the direction of the top portion using pivot portion 472 as a rotational axis, the signal blocking portion 473*c* may move out of between the light emitting portion and the light receiving portion and therefore, the state in which ink is depleted may be detected. Moreover, when the specific gravity of the materials comprising float portion 471 are less than the specific gravity of ink, it may be unnecessary to manufacture complex dies, such that the manufacturing cost of movable member 470 may be reduced.

Figure 5C:
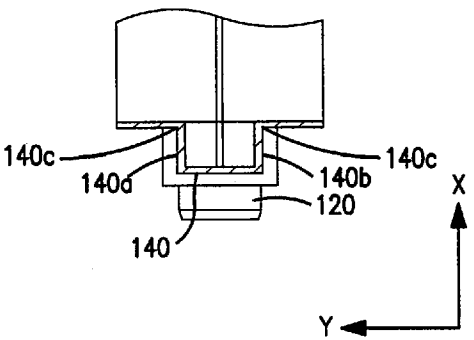
FIG. 5(*a*) is a side view of an ink reservoir element.
Figure 5B:
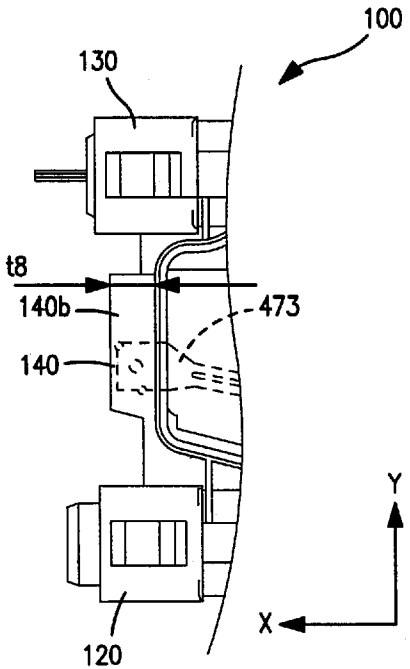
Figure 5A:
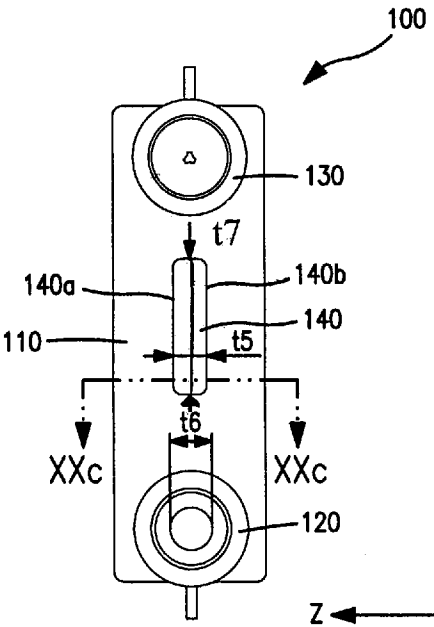

Referring to FIGS. 5(*a*), and 5(*b*), ink supply portion 120, ambient air intake portion 130, and translucent portion 140 may be provided on one of the side surfaces of frame portion 110. When ink cartridge 14 is installed within the multifunction device, ambient air intake portion 130, translucent portion 140, and ink supply portion 120 may be sequentially aligned from top to bottom.

Referring to FIG. 5(*a*), a width t5 of translucent portion 140 may be less than a diameter t6 of the opening of ink supply portion 120, and a length t7 of translucent portion 140 may be greater than width t5 of translucent portion 140. Referring to FIG. 5(*b*), translucent portion 140 may be receded in the direction of frame portion with respect to ink supply portion 120 and ambient air intake portion 130. A width t8 of translucent portion 140 may be greater than width t5 of translucent portion 140.

Arm portion 473 of movable member 470 may be positioned within the inner space of translucent portion 140, and the light path of the sensor may be opened from the light-blocking state due to the rotation of arm portion 473, and the amount of ink may be detected. The light receiving portion and the light emitting portion may be positioned on both sides of translucent portion 140, such that both side surfaces of translucent portion 140 form detection surfaces 140*a* and 140*b*. Referring again to FIG. 5(*a*), detection surfaces 140*a* and 140*b* may be parallel to the height direction, e.g., Y-direction, of ink cartridge 14 when ink cartridge 14 is installed in the multifunction device.

When ink adheres to detection surfaces 140*a* and 140*b*, it may be difficult to accurately detect the amount of ink. Referring to FIG. 5(*b*), translucent portion 140 may be provided in a position withdrawn to the side of ink chamber 111 with respect to ink supply portion 120, such that it may be difficult for ink to adhere to translucent portion 140 even when ink drips from ink supply portion 120. Specifically, the ink which drops from ink supply portion 120 generally may not head towards translucent portion 140, such that it does not adhere to translucent portion 140.

Because detection surfaces 140*a* and 140*b* are vertical when ink cartridge 14 is installed in the multifunction device, the ink may be most susceptible to the effects of gravity when ink cartridge 14 is installed in the multifunction device. Therefore, even if the ink has adhered to detection surfaces 140*a* and 140*b*, it drops relatively quickly. It therefore may be possible to substantially avoid the transfer of ink to the light receiving portion and the light emitting portion of the sensor. Moreover, the ink which drops from detection surfaces 140*a* and 140*b* may not adhere to the end surface of ink supply portion 120.

Referring to FIG. 5(*c*), side walls which form detection walls 140*a* and 140*b* extending from the side surface of frame portion 110 may be provided on translucent portion 140. Therefore, an edge portion 140*c* where the side surface of frame portion 110 and detection surfaces 140*a* and 140*b* intersect may be provided at a substantially perpendicular angle. When ink adheres to the vicinity of edge 140*c*, the capillary force of edge 140*c* acts upon the ink because edge 140*c* may be provided at a substantially perpendicular angle, and the ink may flow towards ink supply portion 120 along edge 140*c*. It therefore may be possible to reduce the adherence of ink to detection surfaces 140*a* and 140*b*.

When ink cartridge 14 is installed in the multifunction device, ink cartridge 14 may be installed, such that ink supply portion 120 is located below ambient air intake portion 130. This state may be the installation position of ink cartridge 14. Moreover, when ink cartridge 14 is installed in the multifunction device, ink supply portion 120, translucent portion 140, and ambient air intake portion 130 may be sequentially positioned from bottom to top, and ink supply portion 120, translucent portion 140, and ambient air intake portion 130 may be provided on a single end surface. Therefore, because ink supply portion 120, translucent portion 140, and ambient air intake portion 130 are provided, such that they are focused, e.g., positioned adjacent to each other, on a single end surface, the sensor, a needle configured to be connected with the ink supply portion (not shown), and a passage configured to be connected with air intake portion 130 (not shown) associated with the multifunction device may be consolidated on a single surface, such that the size of the multifunction device may be reduced.

Ink supply portion 120 and translucent portion 140 may be sequentially provided on the single end surface from top to bottom, and by using movable member 470 for detecting ink, the ink may be used to the fullest extent. For example, when the amount of ink is detected by irradiating a portion of the ink cartridge using a photo-detector, if a method in which the presence of ink may be detected directly were used, the ink could not be fully used with a configuration in which the ink supply opening and the irradiated portion which may be irradiated by photo-detector are both provided on a single end surface, as in this embodiment. Specifically, if the irradiated portion is positioned below the ink supply opening, the position of the ink supply opening becomes relatively high, such that ink which is stored below the ink supply opening may not be used. Conversely, if the irradiated portion is positioned above the ink supply opening, the position of the irradiated portion becomes relatively high, such that a significant quantity of ink may be inside the ink cartridge when the photo-detector detects the absence of ink. Nevertheless, in this embodiment, movable member 470 may be used, such that even when the irradiated portion is provided in a relatively high position, the absence of ink may be detected in step with the timing in which the actual amount of ink becomes low, and the ink supply opening may be provided in a low position, such that there may be an insignificant amount of ink inside the ink cartridge when the absence of ink is detected.

Referring to FIGS. 3(*a*), 8(*a*), and 8(*b*), when ink cartridge 14 is installed in the multifunction device, the light emitting portion and the light receiving portion of the sensor may be positioned at positions sandwiching translucent portion 140. Because signal blocking portion 473*c* of movable member 470 may be positioned in enclosure portion 141 of translucent portion 140, the ink quantity may be detected by the operation of movable member 470.

The direction of rotation of movable member 470 may be determined based on the combined force of the buoyancies and gravities acting on the right side portion and the left side portion. Nevertheless, in order to simply the description of sensor 470, it is assumed that all of the forces which act on movable member 470 also act on float portion 471. Based on this assumption, the rotation of movable member 470 is determined by the buoyancy and the gravity acting on float portion 471. When there is a large amount of ink stored in ink chamber 111, because float portion 471 of movable member 470 may comprise resin material with a lower specific gravity than the specific gravity of ink, the buoyancy generated on float portion 471 increases, and float portion 471 floats in the ink. The combined force of gravity and buoyancy generated on float portion 471 causes a rotating force to be received in the clockwise direction in FIGS. 3(*a*), 8(*a*), and 8(*b*). Nevertheless, signal blocking portion 473*c* contacts translucent portion rib 142, and thus, signal blocking portion 473*c* may be positioned in a position blocking the optical path between the light emitting portion and the light receiving portion of the sensor.

As the ink within ink chamber 111 decreases in quantity, the surface level I of the ink drops. As the surface level I of the ink drops, signal blocking portion 473*c* emerges on the surface level I of the ink, and subsequently, float portion 471 also emerges on the surface level I of the ink. When float portion 471 emerges on the surface level I of the ink, the buoyancy generated on float portion 471, which causes movable member 470 to rotate in the clockwise direction in FIGS. 3(*a*), 8(*a*), and 8(*b*), and the gravity generated on float portion 471, which causes movable member 470 to rotate in the counterclockwise direction in FIGS. 3(*a*), 8(*a*), and 8(*b*), balance each other out, such that the overall combined force may be balanced. Subsequently, as the surface level I of the ink drops further, float portion 471 moves downward following the surface level I, such that movable member 470 rotates counterclockwise. The rotating operation causes signal blocking portion 473*c* to move upward away from translucent portion rib 142, and an optical path may be created between the light emitting portion and the light receiving portion of the sensor. In this state, a controller (not shown) of the multifunction device determines that ink cartridge 14 is out of ink.

As the quantity of ink transitions from a substantial amount of ink to substantially no ink, float portion 471 may transition from an upper position to a lower position within ink chamber 111. Thus, when the quantity of ink in ink chamber 111 is low, an out-of-ink discrimination accurately may be detected.

Figure 6:
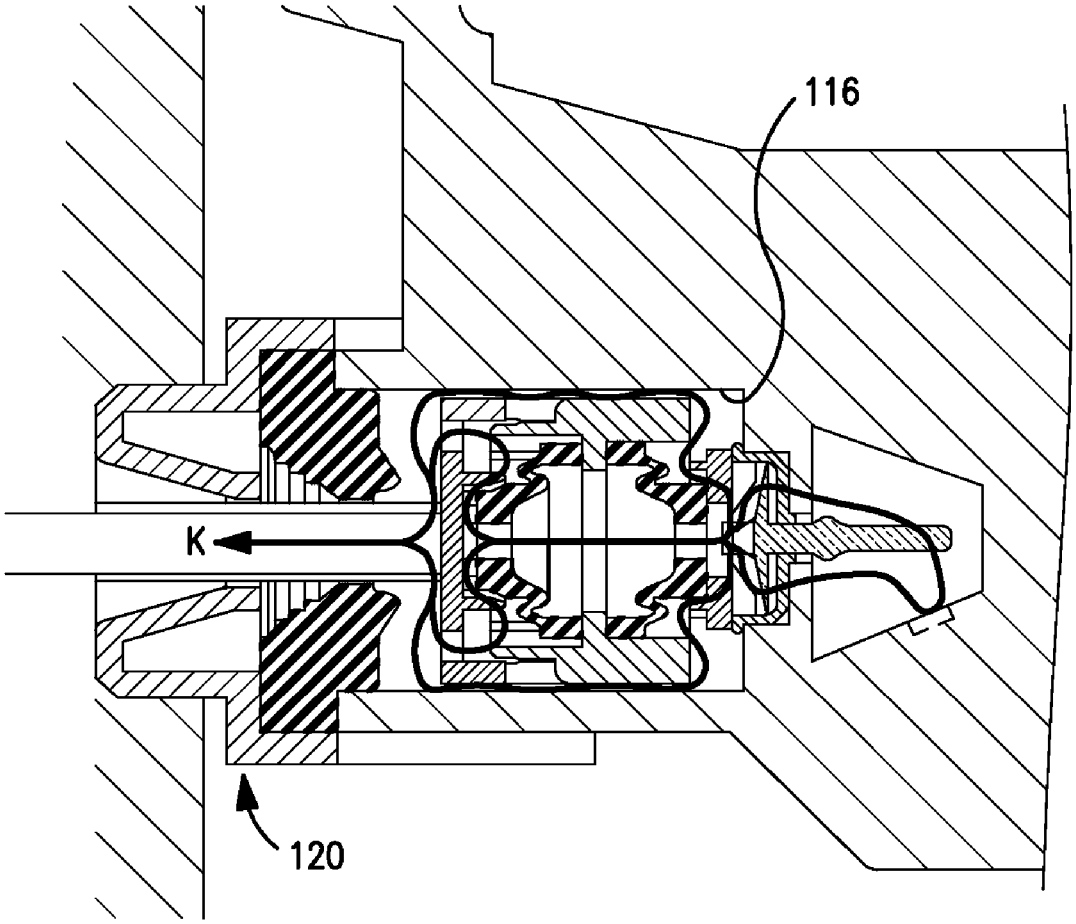
FIG. 6 is a cross-sectional view of a communication path of an ink cartridge, in which the ink cartridge is installed in a printer, according to an embodiment of the present invention.

Referring to FIG. 6, a communication path 116 may be formed within ink cartridge 14, and ink may flow through communication path 116 as shown by the arrow K. Communication path 116 may be in fluid communication with ink chamber 111 and ink supply portion 120, and may be configured to dispense ink from an interior of ink chamber 111 to an exterior of ink chamber 111 via an opening formed in ink supply portion 120. Communication path 116 may be substantially perpendicular to the wall on which ink supply portion 120, ambient air intake portion 130, and translucent portion 140 are formed.

Figure 9A:
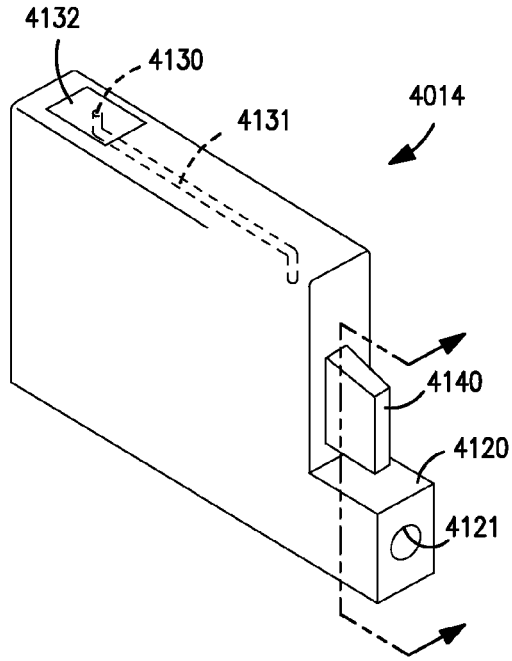
FIG. 9(*a*) is a perspective view of an ink cartridge according to another embodiment of the present invention.
Figure 9B:
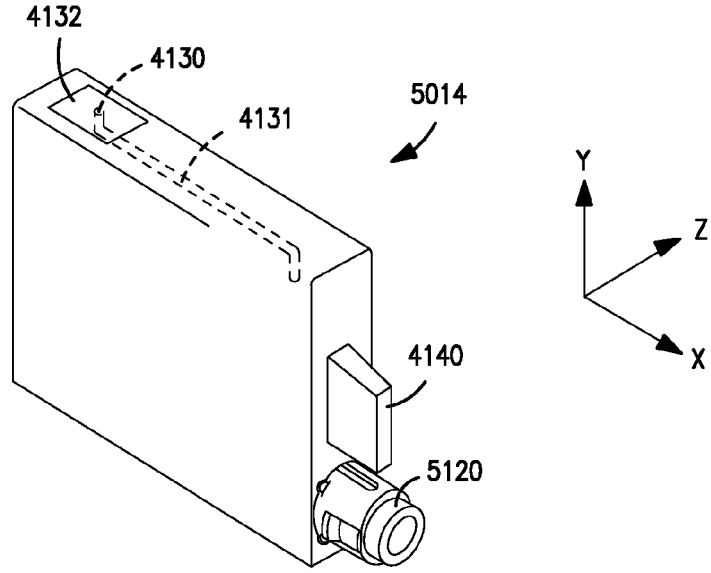

Referring to FIG. 9(*a*), an ink cartridge 4014 according to yet another embodiment of the present invention is depicted. Ink cartridge 4014 may have a through-hole 4130 for admitting ambient air into ink cartridge 4014 provided in a portion of its top surface. The air admitted through through-hole 4130 may pass through a labyrinth shaped air intake passage 4131 and may be admitted within ink cartridge 4014. A seal member 4132 may be glued to ink cartridge 4014 to prevent deaeration and outflow of ink within ink cartridge 4014 before use. To use ink cartridge 4014, seal member 4132 may be peeled off, and then the cartridge is installed the multifunction device.

A portion 4140 may be a protrusion provided outward from one end surface extending substantially in the vertical direction of ink cartridge 4014, and below which may be provided ink supply portion 4120. Portion 4140 may be translucent. An ink supply opening 4121 into which a needle of the multifunction device may be inserted may be provided on the protrusion tip of ink supply portion 4120. Ink cartridge 4014 may not have a structure corresponding to ink reservoir element 100, and stores the ink directly within the case. A movable member like movable member 470 may be provided within ink cartridge 4014 and a signal blocking portion of the movable member may be positioned within portion 4140. Alternatively, portion 4140 may not be translucent, e.g. opaque, and the movable member may not be within the ink cartridge. In this case, an ink amount in ink cartridge 4014 may not be detected by the sensor. However, at least presence and absence of ink cartridge 4014 can be detected by the sensor because portion 4140 blocks the light emitted from the light emitting portion of the sensor when ink cartridge 4014 is installed in the multifunction device.

Referring to FIG. 9(*b*), an ink cartridge 5014 according to still yet another embodiment of the present invention is depicted. Ink cartridge 5014 may be substantially the same as ink cartridge 4014, except that ink supply portion 4120 has been replaced by ink supply portion 5120.

Figure 10:
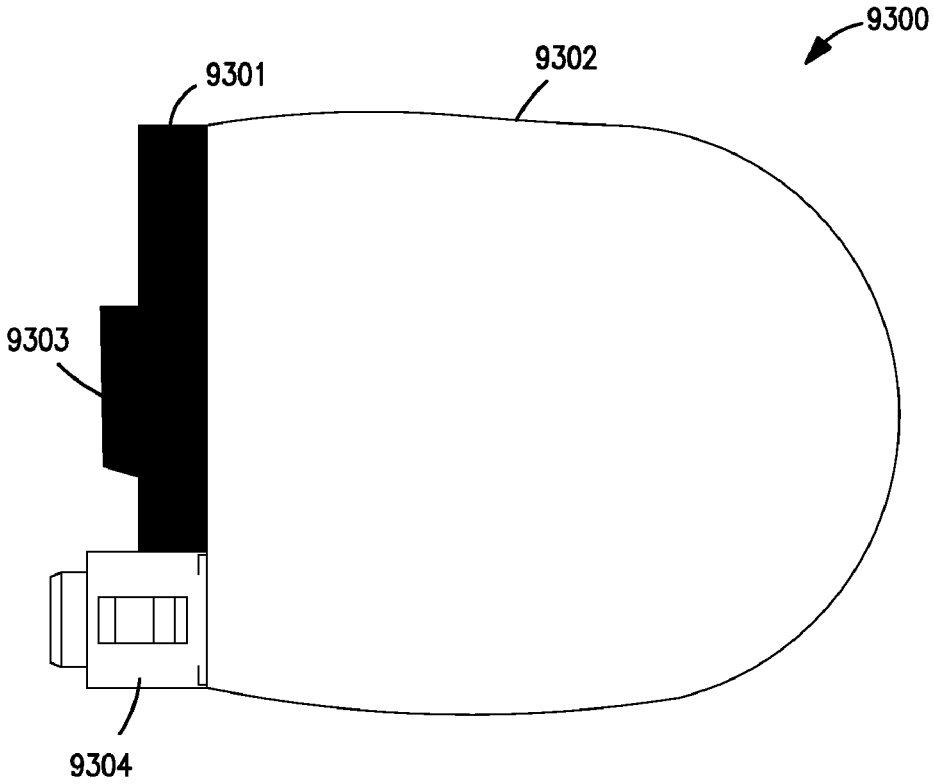
FIG. 10 is a side view of an ink reservoir element, according to another embodiment of the present invention.

Referring to FIG. 10, an ink reservoir element 9300 according to another embodiment of the present invention is depicted. Ink reservoir element 9300 may be substantially similar to ink reservoir element 100. Therefore, only the differences between ink reservoir element 9300 and ink reservoir element 100 are discussed with respect to ink reservoir element 9300. Ink reservoir element 9300 may be fixed within the first and second case members. Ink reservoir element 9300 may comprise a hard portion 9301 which may be provided through injection molding using a resin material, and a bag element 9302 connected to hard portion 9301, which may be a flexible element which forms a reservoir space for storing ink therein. Hard portion 9301 may comprise a detection portion 9303 which may be configured to be positioned between the light emitting portion and the light receiving portion of the sensor. In operation, when the ink within bag portion 9302 is reduced, bag portion 9302 may shrink in response to the reduction in ink, and the ink is substantially depleted, the reservoir space also may be substantially depleted. Therefore, it may be difficult to position a movable member within bag portion 9302 to detect the amount of ink remaining within bag portion 9302.

Moreover, hard portion 9301 may have light barrier properties, and because it may be positioned between the light emitting portion and the light receiving portion, it may block the emitted light which is emitted from the light emitting portion. Therefore, it may be possible to detect whether there is an ink reservoir element 9300 contained within the first and second case members, and as such, it may be possible to prevent printing processes from being performed by the multifunction device when no ink reservoir 9300 is present.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge, comprising:

an ink chamber;

a translucent portion configured to be in fluid communication with the ink chamber, wherein the translucent portion has an inner space formed therein, and the translucent portion comprises a first wall, a second wall opposite the first wall, and a third wall connected to each of the first wall and the second wall;

a signal blocking member disposed within the inner space of the translucent portion between the first wall and the second wall; and a translucent portion rib disposed within the inner space of the translucent portion between the first wall and the second wall, wherein the translucent portion rib extends a from the third wall, a first distance between the translucent portion rib and the first wall is less than a second distance between the signal blocking member and the first wall, and the signal blocking member is configured to move within the inner space of the translucent portion between a first position and a second position based on an amount of ink within the ink chamber, wherein when the signal blocking member is in the first position the signal blocking member is in contact with the translucent portion rib, and when the signal blocking member is in the second position the signal blocking member is separated from the translucent portion rib.

2. The ink cartridge of claim 1, wherein a third distance between the translucent portion rib and the second wall is the same as the first distance, and a fourth distance between the signal blocking member and the second wall is substantially the same as the second distance.

3. The ink cartridge of claim 1, wherein a sum of the first distance and a third distance between the translucent portion rib and the second wall is less than a sum of the second distance and a fourth distance between the signal blocking member and the second wall.

4. The ink cartridge of claim 1, wherein the third wall is slanted with respect to at least one of the first wall and the second wall.

5. The ink cartridge of claim 1, wherein at least one intersection between the third wall and the translucent portion rib comprises a right angle.

6. The ink cartridge of claim 1, wherein the ink chamber has a first end and a second end, and the ink cartridge further comprises:

a communication path disposed adjacent to the second end of the ink chamber; and an ink supply portion coupled to the communication path, wherein the communication path is configured to dispense ink from an interior of the ink chamber to an exterior of the ink chamber via the ink supply portion, and the translucent portion is positioned between the first end of the ink chamber and the communication path.

7. The ink cartridge of claim 6, further comprising an air intake portion disposed adjacent to the first end of the ink chamber, wherein the translucent portion is positioned between the air intake portion and the communication path.

8. The ink cartridge of claim 6, further comprising a float member disposed within the ink chamber and connected to the signal blocking member, wherein the float member is configured to move between a third position and a fourth position and the signal blocking member is configured to move within the inner space based at least on an amount of ink disposed within the ink chamber.

9. The ink cartridge of claim 8, wherein as the ink within the ink chamber is dispensed from the interior of the ink chamber to the exterior of the ink chamber a surface of the ink within the ink chamber moves in a first predetermined direction, and when the float member moves from the third position to the fourth position the float member moves in the first predetermined direction and the signal blocking portion moves within the inner space of the translucent portion in a second predetermined direction which is opposite the first predetermined direction.

10. The ink cartridge of claim 1, wherein an area of the first wall and an area of the second wall each are greater tan an area of the third wall.

11. The ink cartridge of claim 1, wherein a direction of movement of the signal blocking member is substantially perpendicular to the third wall.

12. The ink cartridge of claim 11, wherein the direction of movement of the signal blocking member is substantially parallel to at least one of the first wall and the second wall.

13. The ink cartridge of claim 1, wherein the ink chamber comprises a particular ink chamber wall, and the translucent portion extends outwardly from an exterior of the particular ink chamber wall, such that a portion of each of the first wall, the second wall, and the third wall is connected to a portion of the particular ink chamber wall, wherein the ink cartridge further comprises an ink chamber rib extending from an interior of the particular ink chamber wall.

14. The ink cartridge of claim 13, wherein at least a portion of the ink chamber rib is slanted with respect to the translucent portion rib.

15. The ink cartridge of claim 13, wherein the ink chamber rib comprises a first portion and a second portion connected to the first portion, wherein the first portion is disposed adjacent to and perpendicular to the translucent portion rib, and the second portion is slanted with respect to the translucent portion rib and the first portion.

16. The ink cartridge of claim 13, wherein an area of the first wall and an area of the second wall each are greater than an area of the third wall.

17. The ink cartridge of claim 1, wherein the first wall comprises a first portion and a second portion, wherein at least a portion of the first portion is unalligned with at least a portion of the second portion.

18. The ink cartridge of claim 17, wherein the first wall further comprises a third portion connected to each of the first portion and the second portion, wherein the third portion is one of perpendicular to the first portion and slanted with respect to the first portion.

19. The ink cartridge of claim 1, wherein at least one intersection portion between the third wall and the translucent portion rib comprises a rounded portion.

* * * * *